US008640849B2

(12) United States Patent
Nireki

(10) Patent No.: US 8,640,849 B2
(45) Date of Patent: Feb. 4, 2014

(54) PAPER SHEET PROCESSING DEVICE

(75) Inventor: Takao Nireki, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 598 days.

(21) Appl. No.: 12/810,689

(22) PCT Filed: Dec. 24, 2008

(86) PCT No.: PCT/JP2008/073491

§ 371 (c)(1),
(2), (4) Date: Jun. 25, 2010

(87) PCT Pub. No.: WO2009/081954

PCT Pub. Date: Jul. 2, 2009

(65) Prior Publication Data

US 2010/0270120 A1 Oct. 28, 2010

(30) Foreign Application Priority Data

Dec. 26, 2007 (JP) ..... 2007-334950

(51) Int. Cl.
*G07D 7/00* (2006.01)

(52) U.S. Cl.
USPC ..... 194/203; 194/202; 194/206; 194/344; 194/351

(58) Field of Classification Search
USPC ..... 194/206, 207, 203, 202, 344–347, 194/349–351; 209/534
See application file for complete search history.

(56) References Cited

U.S. PATENT DOCUMENTS

| | | | | |
|---|---|---|---|---|
| 5,195,739 | A * | 3/1993 | Watabe | 271/207 |
| 5,372,361 | A * | 12/1994 | Isobe et al. | 271/181 |
| 2004/0212145 | A1 * | 10/2004 | Yang et al. | 271/272 |
| 2004/0217536 | A1 * | 11/2004 | Isobe et al. | 271/3.14 |

FOREIGN PATENT DOCUMENTS

| | | |
|---|---|---|
| JP | 63 89181 | 6/1988 |
| JP | 8 279065 | 10/1996 |
| JP | 2005 4375 | 1/2005 |

* cited by examiner

*Primary Examiner* — Jeffrey Shapiro
(74) *Attorney, Agent, or Firm* — Lexyoume IP Meister, PLLC.

(57) ABSTRACT

A paper sheet processing apparatus capable of preventing an action of drawing out a paper sheet such as a bill is provided. A bill processing apparatus of the present invention has an insertion slot into which a bill is inserted and a traveling route through which the bill inserted into the insertion slot is conveyed. The traveling route has a first traveling route (3A) connected to the insertion slot and a second traveling route (3B) extending downstream from the first traveling route (3A) and being inclined relative to the first traveling route (3A). The second traveling route (3B) is provided with a shutter member (200) for preventing conveyance of the bill toward the insertion slot.

5 Claims, 9 Drawing Sheets

PAPER SHEET PROCESSING DEVICE

FIELD OF THE INVENTION

The present invention relates to a paper sheet processing apparatus (or device) which prevents an action of drawing out bills, cards, coupon tickets, and so on (hereafter collectively referred to as "paper sheet") having been inserted from an insertion slot.

BACKGROUND ART

In general, a bill processing apparatus, which is one of the embodiments of the paper sheet apparatus, is incorporated into a service device such as a game medium rental machine installed in a game hall, a vending machine or a ticket-vending machine installed in a public space, or the like which identifies the validity of a bill inserted from a bill insertion slot by a user and provides various types of products and services in accordance with a value of the bill having been judged as valid. Such a bill processing apparatus includes a bill conveyance mechanism that conveys a bill inserted into a bill insertion slot, and a bill identification part that judges the validity of the bill (or also called authenticity judgment) to be conveyed.

In the bill processing apparatus described above, after a bill is inserted from the bill insertion slot, it is necessary to prevent the inserted bill from being drawn out for the purpose of fraudulent activity. For example, Patent Document 1 discloses a configuration in which a tongue piece projecting from the frame is provided to a portion on the front side of a discharge slot in a bill processing apparatus in which a bill inserted into a bill insertion slot is conveyed to the discharge slot by a roller, or the like. This tongue piece is configured to rise up so as to be inclined on the surface of a traveling route through which a bill moves, that allows the bill to move in its traveling direction along the inclined surface, and when the bill moves in its opposite direction (moves in a drawing-out direction), the bill comes to be caught by the tongue piece.

[Patent Reference 1] Japanese unexamined utility model application publication No. S63-89181

DISCLOSURE OF THE INVENTION

Problem to be Solved by the Invention

In the bill processing apparatus disclosed in Patent Document 1 described above, because the bill traveling route from the bill insertion slot to the discharge slot is linearly formed, it is possible to recognize the tongue piece from the insertion slot. Therefore, there is a possibility that the engagement between the bill and the tongue piece is cancelled by insertion of foreign matter from the insertion slot to commit an action of drawing out the bill.

In the present invention, a paper sheet processing apparatus which is capable of preventing an action of drawing out paper sheets such as bills and the like is provided.

Means to Solve the Problem

In the present invention, a paper sheet processing apparatus comprises an insertion slot into which a paper sheet is inserted, and a traveling route through which the paper sheet inserted into the insertion slot is conveyed, wherein the traveling route has a first traveling route provided so as to be connected to the insertion slot and a second traveling route to extend from the first traveling route toward the downstream side and to be inclined at a predetermined angle to the first traveling route, and wherein a shutter member that prevents the paper sheet from being conveyed toward the insertion slot is installed in the second traveling route. Further features of the present invention, its nature, and various advantages will be more apparent from the accompanying drawings and the following description of the preferred embodiment.

DESCRIPTION OF NOTATIONS

Figure 1:
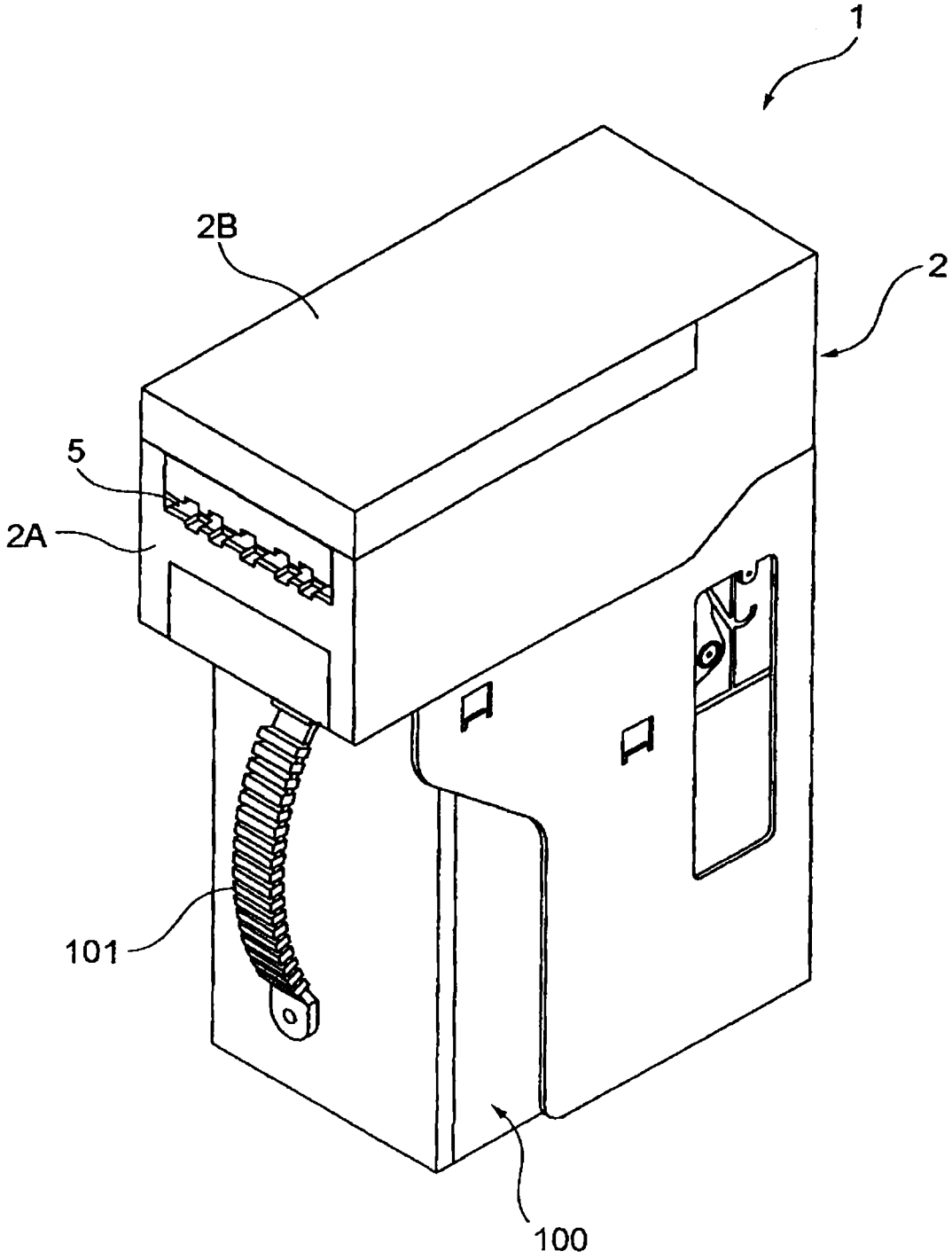
FIG. 1 is a perspective view showing an entire structure to illustrate a configuration of a bill processing apparatus of this embodiment.

1 bill processing apparatus
2 apparatus main body
2A frame
2B open/close member
2F frame
3 bill traveling route
3A first traveling route
3B second traveling route
3R recess
5 bill insertion slot
6 bill conveyance mechanism
8 bill reading means
10 skew correction mechanism
100 bill housing part
200 shutter member
202 movable piece
202*a* regulating part 202*a*

BEST MODE FOR CARRYING OUT THE INVENTION

Figure 2:
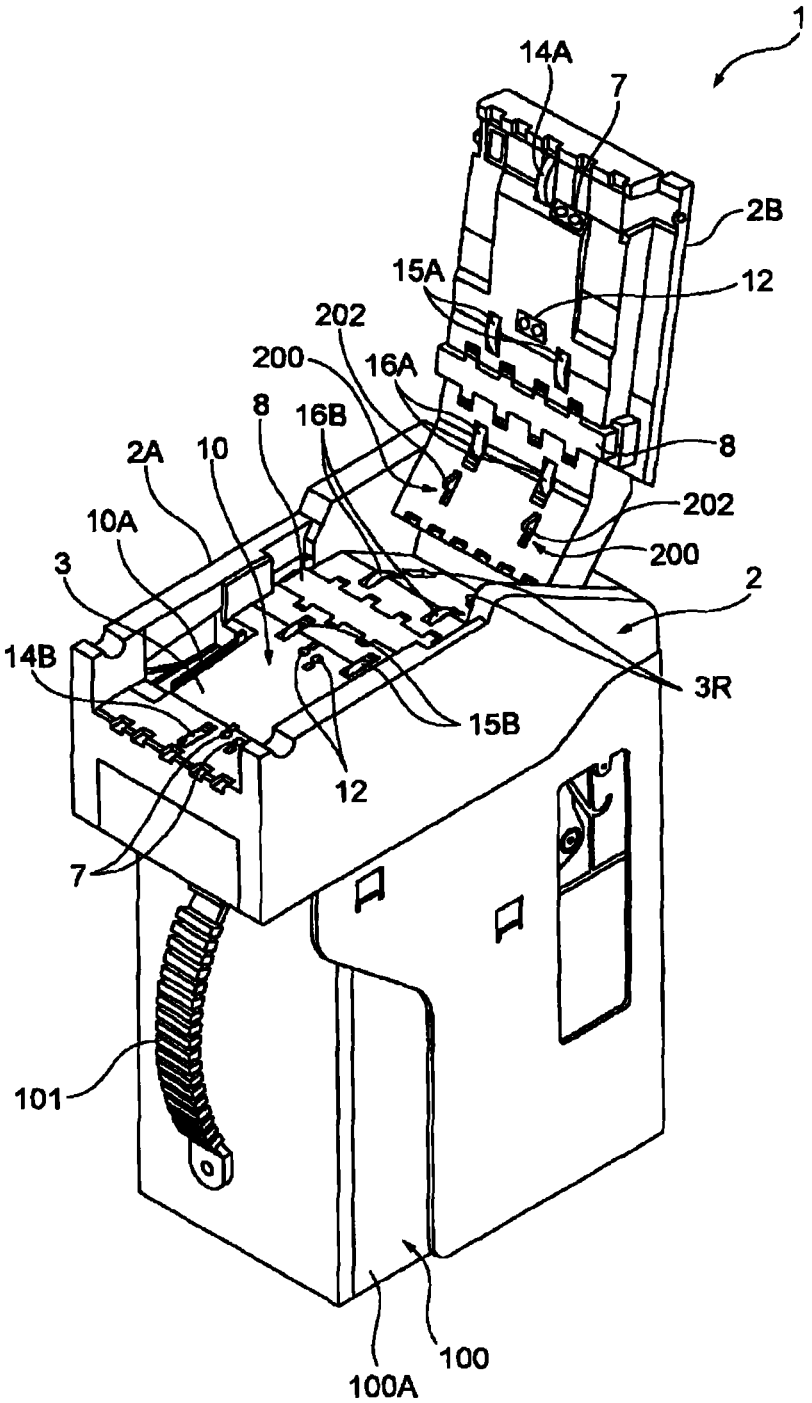
FIG. 2 is a perspective view showing the bill processing apparatus in a state that an open/close member is opened for a main body frame of an apparatus main body.
Figure 3:
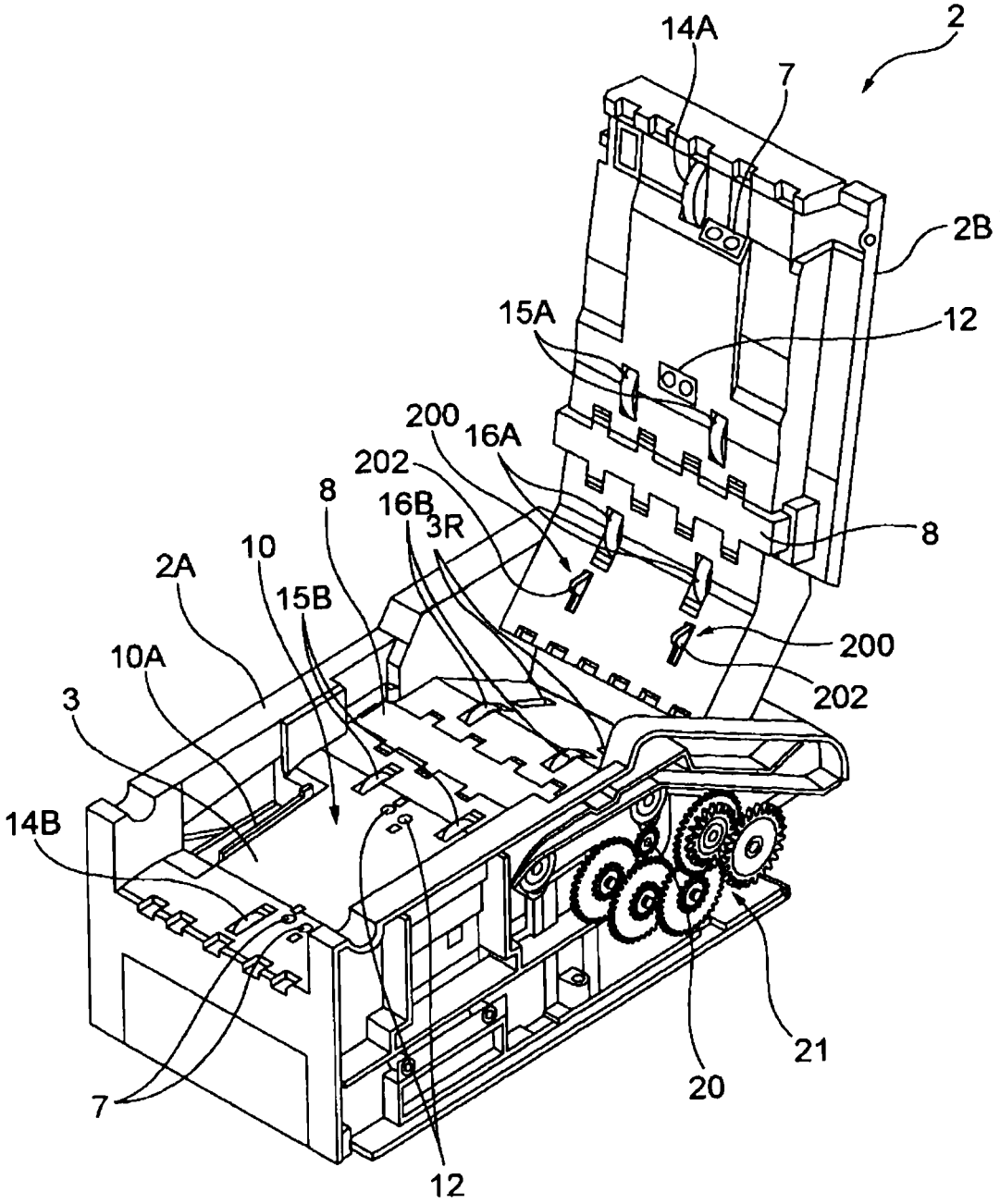
FIG. 3 is a perspective view showing a configuration of a power transmission part of the apparatus main body.
Figure 4:
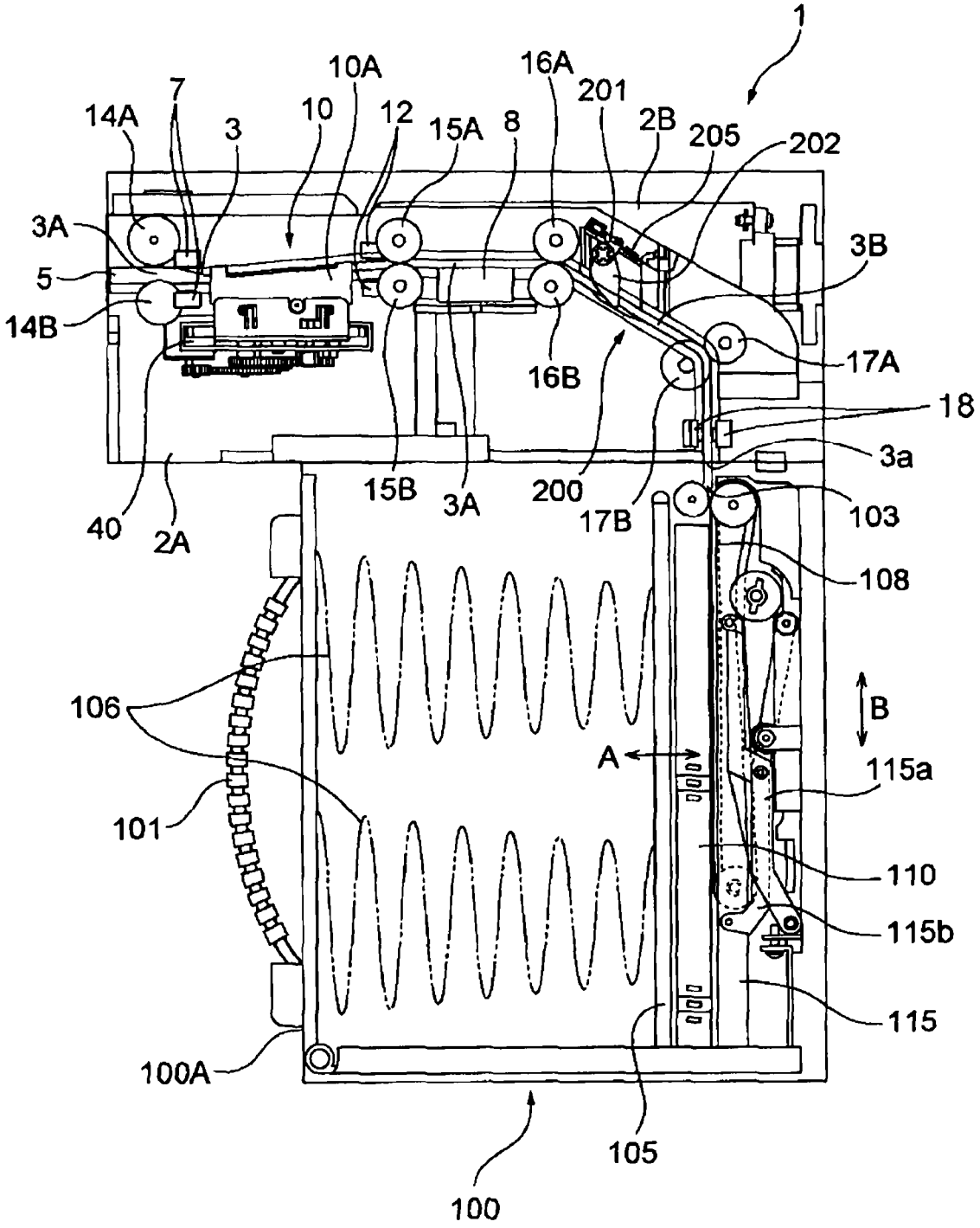
FIG. 4 is a right side view schematically showing a traveling route of a bill to be inserted from an insertion slot.
Figure 5:
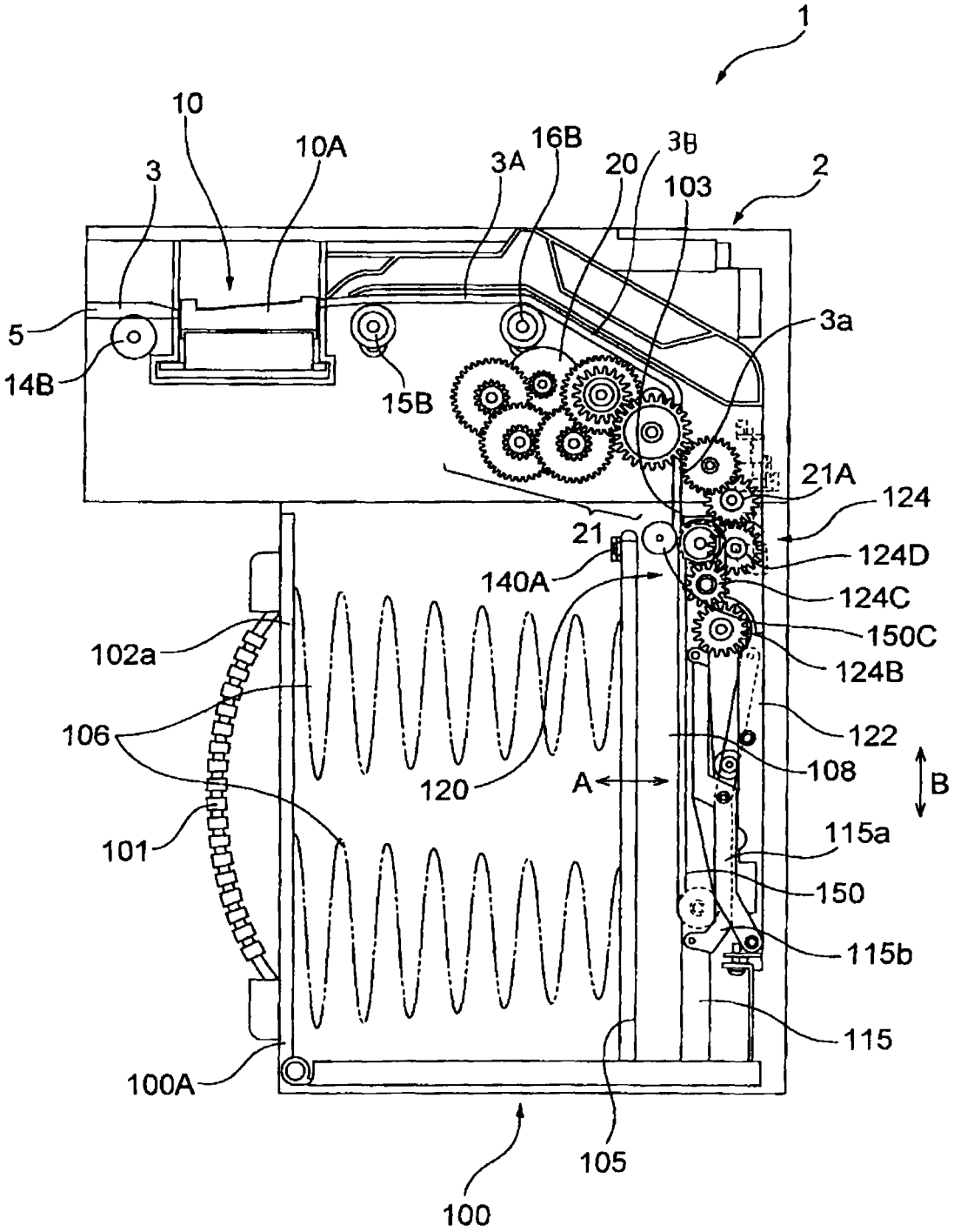
FIG. 5 is a view showing a schematic configuration of a power transmission mechanism for driving a presser plate arranged in a bill housing part.
Figure 6:
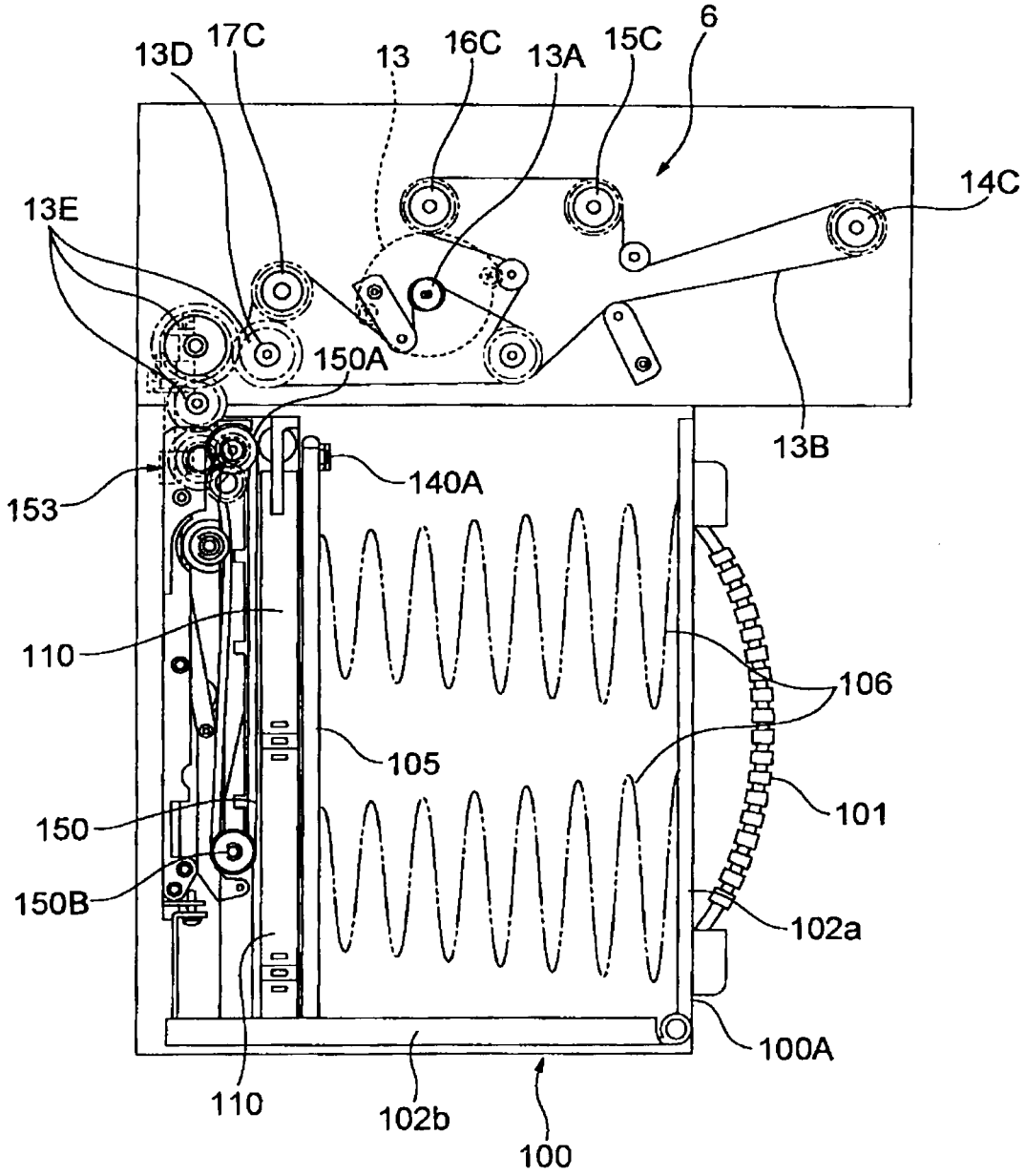
FIG. 6 is a left side view showing a schematic configuration of a driving source and a driving force transmission mechanism to drive a bill conveyance mechanism.

FIGS. 1 to 6 are diagrams showing the configuration of a bill processing apparatus as one of the embodiments according to the present invention. FIG. 1 is a perspective view showing an entire configuration thereof, FIG. 2 is a perspective view showing a state that an open/close member is opened for a main body frame of an apparatus main body, FIG. 3 is a perspective view showing a configuration of a power transmission part of the apparatus main body, FIG. 4 is a right side view schematically showing a traveling route of a bill inserted from an insertion slot, FIG. 5 is a view showing a schematic configuration of a power transmission mechanism to drive a presser plate disposed in a bill housing part, and FIG. 6 is a left side view showing a schematic configuration of a driving source and a driving force transmission mechanism to drive a bill conveyance mechanism.

A bill processing apparatus 1 of this embodiment is configured to be incorporable into, for example, various types of gaming machines such as a slot machine and the like, and the bill processing apparatus 1 comprises an apparatus main body 2 and a bill housing part (bill stacker) 100 which is provided on the apparatus main body 2 and is capable of stacking and housing a great number of bills. The bill housing part 100 has a function as a safe and is configured to be mountable to and demountable from a frame 2A constituting the apparatus main body 2. In this embodiment, for example, it is possible to remove the bill housing part 100 from the frame 2A of the apparatus main body 2 by pulling a handle 101 fixed to a front face thereof in a state that a lock mechanism (not shown) is unlocked.

As shown in FIGS. 2 and 3, the apparatus main body 2 has the frame 2A and an open/close member 2B configured to be opened and closed for the frame 2A by rotating around an axis positioned at one end thereof as a rotating center. Then, as shown in FIG. 4, the frame 2A and the open/close member 2B are configured to form a space (bill traveling route) 3 through which a bill is carried such that both face each other across the space when the open/close member 2B is closed for the frame 2A, and to form a bill insertion slot 5 such that front exposed faces of both are aligned and that the bill traveling route 3 exits at the bill insertion slot 5. In addition, the bill insertion slot 5 is a slit-like opening from which a short side of a bill can be inserted into the inside of the apparatus main body 2.

In the apparatus main body 2, a bill conveyance mechanism 6 that conveys a bill; an insertion detecting sensor 7 that detects the bill inserted into the bill insertion slot 5; bill reading means 8 that is installed on a downstream side of the insertion detecting sensor 7, and reads information from the bill in a travelling sate; a skew correction mechanism 10 that accurately positions and conveys the bill with respect to the bill reading means 8; a movable piece passage detecting sensor 12 that detects that the bill passes through movable pieces constituting the skew correction mechanism 10; and a discharge detecting sensor 18 that detects that the bill is discharged into the bill housing part 100 are provided.

Hereafter, the respective components described above will be described in detail. The bill traveling route 3 is extended from the bill insertion slot 5 toward the back side, and comprises a first traveling route 3A and a second traveling route 3B which is extended from the first traveling route 3A toward downstream side and is inclined at a predetermined angle to the first traveling routes 3A. That is, the second traveling route 3B is bent downward at a predetermined angle toward downstream side and is eventually bent in a vertical direction on the downstream side. A discharge slot 3*a* from which the bill is discharged to the bill housing part 100 is formed in the second bill traveling route 3B, and the bill discharged therefrom is fed into a feed port (receiving port) 103 of the bill housing part 100 in the vertical direction. Here, a size of a cross section area of the bill traveling route 3 is substantially the same size as the insertion slot or a little shorter in the height direction. Therefore, even a wrinkled bill can pass through the insertion slot with ease.

The bill conveyance mechanism 6 is a mechanism capable of carrying the bill inserted from the bill insertion slot 5 along the insertion direction, and of carrying back the bill in an insertion state toward the bill insertion slot 5. The bill conveyance mechanism 6 comprises a motor 13 (refer to FIG. 6) serving as a driving source installed in the apparatus main body 2; and conveyor roller pairs (14A and 14B), (15A and 15B), (16A and 16B), and (17A and 17B) which are installed at predetermined intervals along the bill traveling direction in the bill traveling route 3, and are driven to rotate by the motor 13.

The conveyor roller pairs are installed so as to be partially exposed on the bill traveling route 3, and all the pairs are constituted of driving rollers of the conveyor rollers 14B, 15B, 16B, and 17B installed on the underside of the bill traveling route 3 driven by the motor 13; and pinch-rollers of the conveyor rollers 14A, 15A, 16A, and 17A installed on the upperside and driven by the these driving rollers. In addition, the conveyor roller pair (14A and 14B) to first nip and hold therebetween the bill inserted from the bill insertion slot 5, and to carry the bill toward the back side, as shown in FIGS. 2 and 3, is installed in one portion of the center position of the bill traveling route 3, and a couple of the conveyor roller pairs (15A and 15B), (16A and 16B), or (17A and 17B) being disposed in this order on the downstream side thereof are respectively installed in a couple of portions with a predetermined interval in the lateral direction of the bill traveling route 3.

Further, the conveyor roller pair (14A and 14B) disposed in the vicinity of the bill insertion slot 5 is usually in a state that the upper conveyor roller 14A is spaced from the lower conveyor roller 14B, and the upper conveyor roller 14A is driven to move toward the lower conveyor roller 14B to nip and hold the inserted bill therebetween when insertion of the bill is sensed by the insertion detecting sensor 7.

The upper conveyor roller 14A is controllably driven to be pressed against or spaced from the conveyor roller 14B. In particular, the upper conveyor roller 14A is spaced from the lower conveyor roller 14B so as to release the load on the bill when a process (skew correction process) for positioning the bill for the bill reading means 8 by eliminating tilt of the inserted bill is executed by the skew correction mechanism 10, and the upper conveyor roller 14A is driven to move toward the lower conveyor roller 14B again to nip and hold the bill therebetween when the skew correction process is completed. The skew correction mechanism 10 comprises a pair of right and left movable pieces 10A (only one side is shown) that perform skew correction and the skew correction process is performed by driving a motor 40 for a skew driving mechanism. Here, the traveling route on the upstream side from the skew correction mechanism 10 is formed to be so wide that a inclined bill can pass through, but the traveling route on the downstream side from the skew correction mechanism 10 may be formed narrower. The above-described first traveling route 3A is extended substantially in a horizontal manner toward downstream side as shown in FIG. 4.

The conveyor rollers 14B, 15B, 16B and 17B installed on the underside of the bill traveling route 3 are, as shown in FIG. 6, driven to rotate via the motor 13 and pulleys 14C, 15C, 16C, and 17C installed at the ends of the driving shafts of the respective conveyor rollers. That is, a driving pulley 13A is installed on the output shaft of the motor 13, and a driving belt 13B is wrapped around between the pulleys 14C, 15C, 16C, and 17C installed at the ends of the driving shafts of the respective conveyor rollers and the driving pulley 13A. In addition, tension pulleys are engaged in places with the driving belt 13B, which prevents the driving belt 13B from loosening.

In accordance with the configuration described above, when the motor 13 is driven to normally rotate, the conveyor rollers 14B, 15B, 16B, and 17B are driven to normally rotate in synchronization therewith to carry the bill toward the insertion direction. When the motor 13 is driven to reversely rotate, the conveyor rollers 14B, 15B, 16B, and 17B are driven to reversely rotate in synchronization therewith to carry back the bill toward the bill insertion slot 5 side.

The insertion detecting sensor 7 is to generate a detection signal when a bill inserted into the bill insertion slot 5 is detected. And when the detection signal is generated, the motor 13 is driven in a normal direction and the bill is conveyed in the insertion direction. The insertion detecting sensor 7 of this embodiment is installed between the pair of conveyor rollers (14A and 14B) and the skew correction mechanism 10 and comprises, for example, an optical sensor such as a regressive reflection type photo sensor. However, the insertion detecting sensor 7 may comprise a mechanical sensor other than the optical sensor.

Further, the movable piece passage detecting sensor 12 is to generate a sensed signal when it is sensed that a front end of the bill passes through a pair of right and left movable pieces 10A constituting the skew correction mechanism 10, and when the detection signal is generated, the driving by the motor 13 is stopped such that the skew correction is made. The movable piece passage detecting sensor 12 of this embodiment is disposed on the upstream side from the bill reading means 8 and also comprises an optical sensor or a mechanical sensor in the same way as mentioned before with respect to the insertion detecting sensor.

Further, the discharge detecting sensor 18 is to detect a back end of the bill passing through such that it is detected that the bill is discharged into the bill housing part 100. The discharge detecting sensor 18 is disposed just in front of the receiving port 103 of the bill housing part 100 on the downstream side of the bill traveling route 3. When the detection signal is transmitted from the discharge detecting sensor 18, the driving by the motor 13 is stopped and the conveyance processing of the bill is terminated. The discharge detecting sensor 18 also comprises an optical sensor or a mechanical sensor in the same way as the aforementioned insertion detecting sensor.

The bill reading means 8 reads bill information on the bill carried in a state that the skew is eliminated by the skew correction mechanism 10 (in a state that the bill is accurately positioned), and judges whether the bill is true or false. In detail, for example, the bill reading means 8 may comprise a line sensor that performs reading of the bill such that a bill to be carried is irradiated with light from upper and lower sides, and transmitted light therethrough and reflected light therefrom are detected by a light receiving element. A line sensor is shown in the drawing, and an optical signal read by the line sensor is photoelectric-converted, and the signal is compared and checked with data of a legitimate bill stored in advance, which makes it possible to identify the authenticity of the bill to be carried.

The bill housing part 100 that houses bills is so configured as to stack and house sequentially the bills identified as being genuine by the bill reading means 8.

As shown in FIGS. 4 to 6, the main body frame 100A constituting the bill housing part 100 is formed into a substantially rectangular parallelepiped (or cuboid) shape, and one end of bias means (e.g., bias spring) 106 is attached to an interior side of a front wall 102*a* thereof, and a placing plate 105 on which bills to be fed via the above-described receiving port 103 are sequentially stacked is provided to the other end thereof. Therefore, the placing plate 105 is in a state that it is pressed toward the presser plate 115, which will be described later, by the bias means 106.

In the main body frame 100A, a press standby part 108 that keeps a dropping bill as it falls is provided so as to continuously communicate with the receiving port 103. A pair of regulatory members 110 are disposed on both sides of the press standby part 108, respectively, the regulatory members 110 extending in a vertical direction. An opening, through which the presser plate 115 passes in a process of successively stacking bills onto the placing plate 105, is formed between the pair of regulatory members 110.

Further, protruding walls are formed on both side walls inside the main body frame 100A such that the placing plate 105 may hit and contact thereon when the placing plate is pressed by the biasing means 106. When the placing plate is biased back by the biasing means 106 after bills are sequentially stacked on the placing plate 105, the protruding walls take a holding role to stably hold the stacked bills by hitting and contacting both sides of a surface of an uppermost bill M1 of the stacked bills.

Further, the presser plate 115 that presses toward the placing plate 105 a bill falling into the press standby part 108 from the receiving port 103 is installed in the main body frame 100A. The presser plate 115 is formed in such a size that it may be capable of reciprocating through an opening formed between the pair of regulatory members 110, and gets into the opening so as to be driven to reciprocate between a position where the bills are pressed against the placing plate 105 (a pressing position) and another position where the press standby part 108 is opened (an initial position; refer to FIGS. 9 and 10). Here, the bill passes through the opening as being flexibly bent in a pressing operation of the presser plate 115 and is then placed on the placing plate 105.

The presser plate 115 is driven to reciprocate as described above via a presser plate driving mechanism 120 installed in the main body frame 100A. The presser plate driving mechanism 120 comprises a pair of link members 115*a* and 115*b* having respective ends thereof supported pivotally by the presser plate 115 so as to allow the presser plate 115 to reciprocate in an arrow A direction in FIGS. 4 and 5, and these link members 115*a* and 115*b* are connected in a shape of letter "X", and the other ends opposite to the respective ends are supported pivotally by a movable member 122 installed movably in a vertical direction (an arrow B direction). A rack is formed in the movable member 122, and a pinion constituting the presser plate driving mechanism 120 is geared (engaged) with the rack.

As shown in FIG. 5, a housing part side gear train 124 constituting the presser plate driving mechanism 120 is connected to the pinion. In this case, in this embodiment, as shown in FIGS. 3 and 5, a driving source (a motor 20) and a main body side gear train 21 sequentially engaged with the motor 20 are installed in the above-described apparatus main body 2, and when the bill housing part 100 is mounted to the apparatus main body 2, the main body side gear train 21 is to be connected to the housing part side gear train 124. That is, the housing part side gear train 124 comprises a gear 124B installed on the same axis of the pinion and gears 124C, 124D to be engaged sequentially with the gear 124B, and when the bill housing part 100 is mounted to and demounted from the apparatus main body 2, the gear 124D is configured to be engaged with and disengaged from a final gear 21A of the main body side train 21.

As a result therefrom, the presser plate 115 is driven to reciprocate in the arrow A direction as the motor 20 installed in the apparatus main body 2 is driven to rotate so as to drive the main body side train 21 and in turn the presser plate driving mechanism 120 (the housing part side gear train 124, the rack installed onto the movable member 122, and the link members 115*a*, 115*b*, etc.).

Conveyor members 150 which are capable of touching the bill conveyed-in from the receiving port 103 are installed in the main body frame 100A. The conveyor members 150 take their own role to contact the bill conveyed-in so as to stably guide the bill to an appropriate position in the press standby part 108 (position where the bill can be stably pressed without causing the bill to be moved to the right or left side when the bill is pressed by the presser plate 115). In this embodiment, the conveyor members are constituted of belt-like members (hereafter called belts 150) installed so as to face the press standby part 108.

In this case, the belts 150 are installed so as to extend along the conveying-in direction with respect to the bill, and are wrapped around the pair of pulleys 150A and 150B supported rotatably on both ends in the conveying-in direction. Further, the belts 150 contact a conveyor roller 150C extending in an axis direction which is supported rotatably in the region of the receiving port 103, and the belts 150 and the conveyor roller 150C nip and hold the bill conveyed-in the receiving port 103 therebetween to guide the bill directly to the press standby part 108. Moreover, in this embodiment, the pair of belts 150 are provided on the right and left sides, respectively, across the above-described presser plate 115 in order to be capable of contacting the surface on left and right sides of the bill. Here, the belts 150 may be prevented from loosening by not only being wrapped around the pulleys 150A and 150B at the both ends, but also causing tension pulleys to push the belts 150 at the intermediate positions, respectively.

The pair of belts 150 are configured to be driven by the motor 13 that drives the above-described plurality of conveyor rollers installed in the apparatus main body 2. In detail, as shown in FIG. 6, the above-described driving belt 13B driven by the motor 13 is wrapped around a pulley 13D for the driving force transmission, and a gear train 153 installed at the end of the spindle of the pulley 150A supported rotatably on the receiving port 103 side is engaged with a gear train 13E for the power transmission sequentially installed onto the pulley 13D. That is, when the bill housing part 100 is mounted to the apparatus main body 2, an input gear of the gear train 153 is configured to be engaged with a final gear of the gear train 13E, and the pair of belts 150 are configured to be driven to rotate in a synchronized manner with the above-described conveyor rollers 14B, 15B 16B, and 17B for conveying the bill by driving the motor 13 to rotate. Further, a magnetic sensor (not shown) is installed in the frame 2A of the apparatus main body 2 and a magnet 140A fixed to a central portion of a rear surface of the placing plate 105 of the bill housing part 100 applies the magnetic field to the magnetic sensor when the placing plate 105 is pushed forward against biasing force of biasing means 106. Thus, the magnetic sensor can detect that a predetermined number of bills are placed on the placing plate 105.

As described above, when the bill is inserted into the inside via the bill insertion slot 5, the bill is moved inside the bill traveling route 3 by the bill conveyance mechanism 6. As shown in FIG. 4, the bill traveling route 3 has the first traveling route 3A which is extended from the bill insertion slot 5 toward the back side, and the second traveling route 3B which is extended from the first traveling route 3A toward the downstream side and is inclined at a predetermined angle to the first traveling route 3A. A shutter member 200 that prevents the bill from being conveyed toward the bill insertion slot 5 is installed in the second traveling route 3B. Here, the predetermined angle is an angle formed between the extending direction of the first traveling route 3A and the extending direction of the second traveling direction (for example, $\alpha$ in FIGS. 8A and 8B).

Hereafter, a configuration of the shutter member 200 installed in the second traveling route 3B will be described with reference to FIGS. 4, 7, 8A, and 8B.

The shutter member 200 is installed on the open/close member 2B (refer to FIGS. 2 and 3) being configured to be opened and closed with its one end as a rotating center for the frame 2A of the apparatus main body 2. In detail, the shutter member 200 is installed in the bill traveling route 3 formed when the open/close member 2B is closed for the frame 2A of the apparatus main body 2 and on an upper portion of the second traveling route 3B formed on the downstream side from the first traveling route 3A and on the downstream side from the upper roller 16A constituting the conveyor roller pair (16A and 16B). In this case, it suffices that the shutter member 200 may be disposed on at least one place (for example, on the central place) in the width direction of the second traveling route 3B. However, the shutter members 200 may be disposed on a plurality of places with predetermined intervals. In this embodiment, as shown in FIGS. 2 and 3, the shutter members 200 are disposed on two places in the width direction with predetermined intervals. Disposing the shutter members 200 on the plurality of places can more effectively prevent the bill from being drawn out. In particular, it is preferable that the shutter member 200 is installed mirror-symmetrically to the central line of the second traveling route 3B. This is because it is expected that drawing-out prevention is more effective as the drawing-out force of the shutter member 200 is tended to be distributed evenly.

The shutter member 200 has a spindle 201 supported rotatably by a frame 2F constituting the open/close member 2B, and a movable piece (shutter) 202 in a wedge shape projecting toward the second traveling route 3B is formed integrally with a cylinder portion 201*a* formed in substantially the middle portion of the spindle 201. Further, a locking piece 203 is formed integrally with the cylinder portion 201*a* on an opposite side to the movable piece 202, and biasing means (tension spring) 205 is hooked on one end thereof on the downstream side and locked on the other end thereof to a locking part 203*a* in a hook shape of the locking piece 203. Therefore, the movable piece 202 is biased to rotate in the arrow direction, that is, toward upstream (first rotational direction) around the spindle 201 by the biasing force of the tension spring 205.

Figure 7:
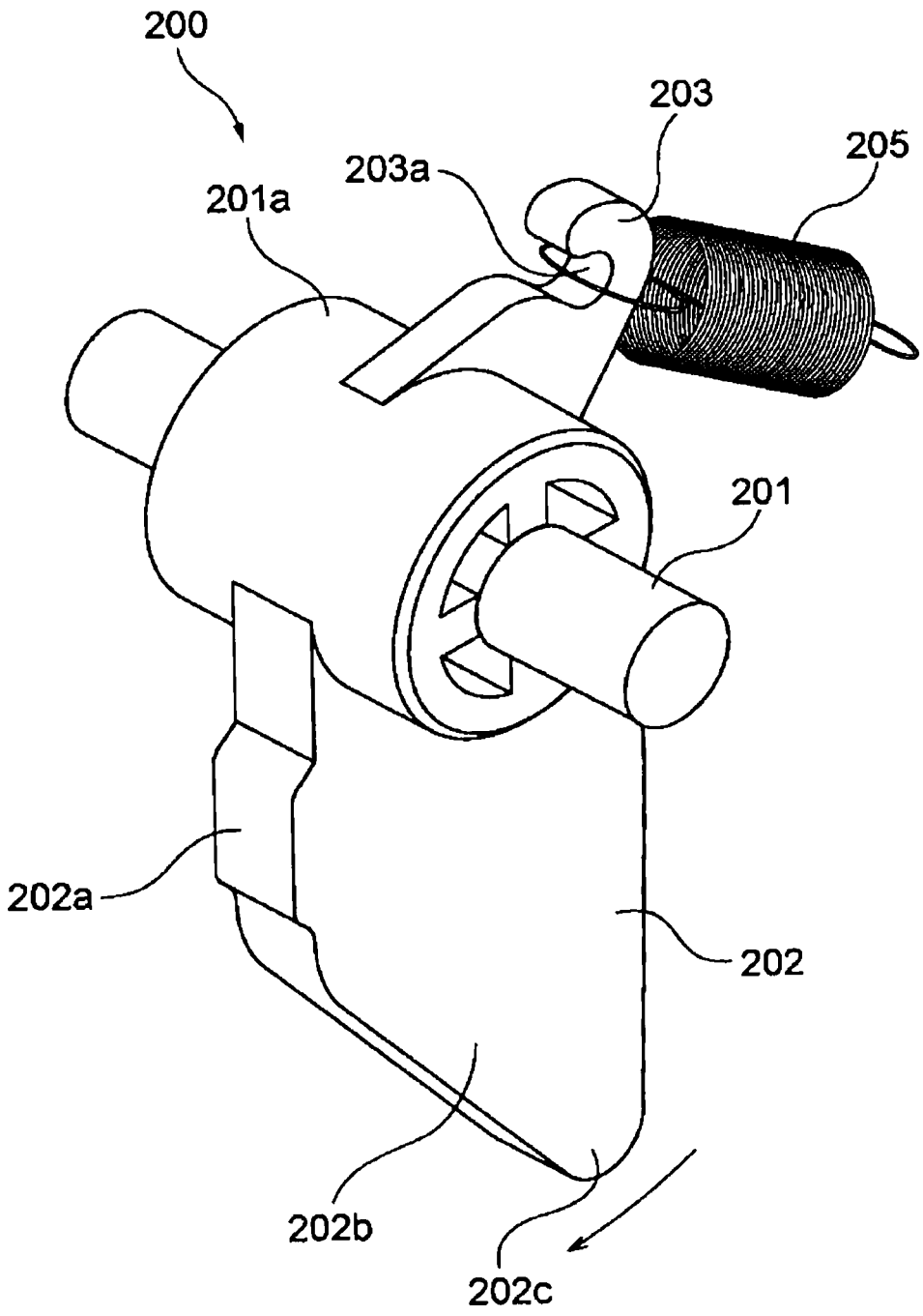
FIG. 7 is a view showing a configuration of a shutter member installed in a second traveling route.

The movable piece 202 has a predetermined width in a lateral direction to the traveling route and a leading end portion of the wedge shape having an inclined face on the upstream side and a root part in a square shape (or rectangular shape) continuing from the leading end portion (refer to FIG. 7). On a surface facing upstream of the root part of the movable piece 202, a regulating part 202*a* is formed in a raised shape toward upstream side and touches a halt wall 2F' of the frame 2F such that the rotation of the movable piece 202 toward the bill insertion slot side (that is, on the upstream side and in the upstream direction, first rotational direction) is regulated. Then, in this state of regulating the rotation, a leading end area 202*b* of the movable piece 202 blocks the second traveling route 3B as shown in FIG. 8A.

Further, a recess 3R is formed at a position in which the leading end portion of the movable piece 202 of the shutter member touches the under surface portion of the second traveling route 3B. This recess 3R is formed so as to be recessed in the under surface of the second traveling route 3B, and when the rotation of the movable piece 202 is regulated by touching the halt wall 2F' of the frame 2F, a leading end portion 202*c* of the movable piece 202 is positioned in the recess 3R. The recess 3R has a width a little wider than that of the movable piece 202 as shown in FIGS. 2 and 3 in this embodiment and the movable piece 202 is configured to be rotatable in the recess 3R.

Figure 8A:
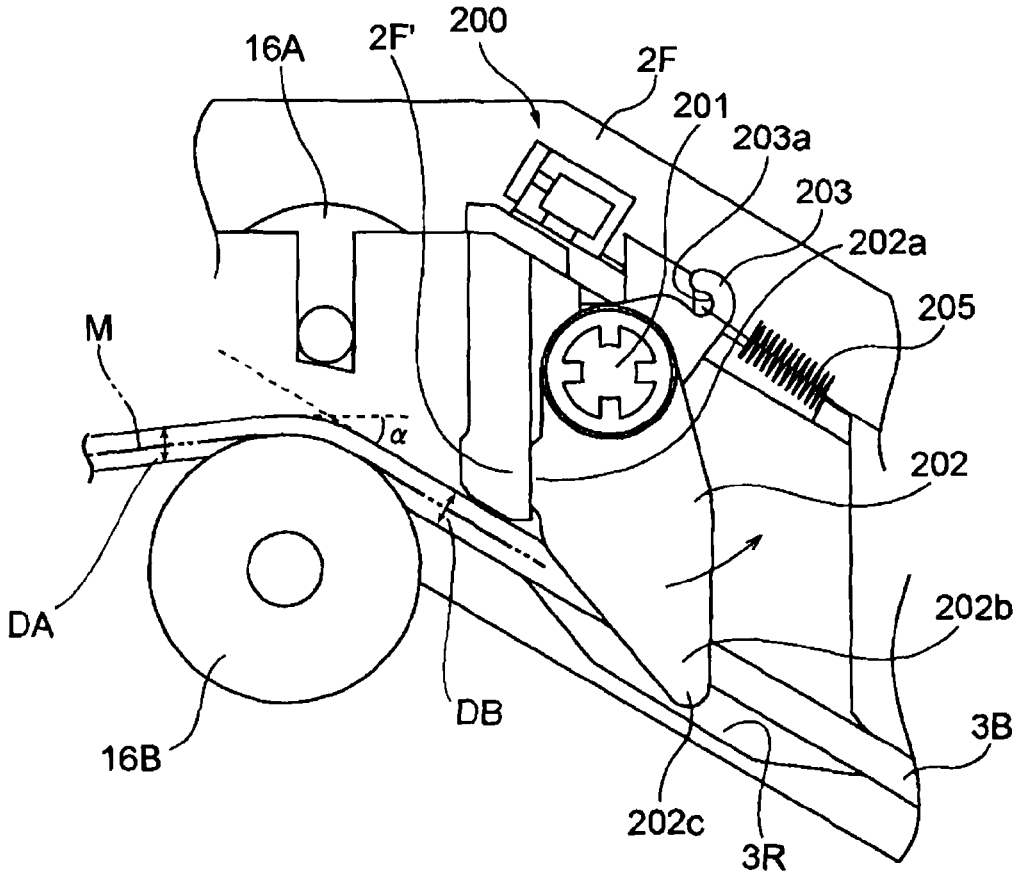
FIG. 8A is a view showing a state that the shutter member closes the second traveling route.
Figure 8B:
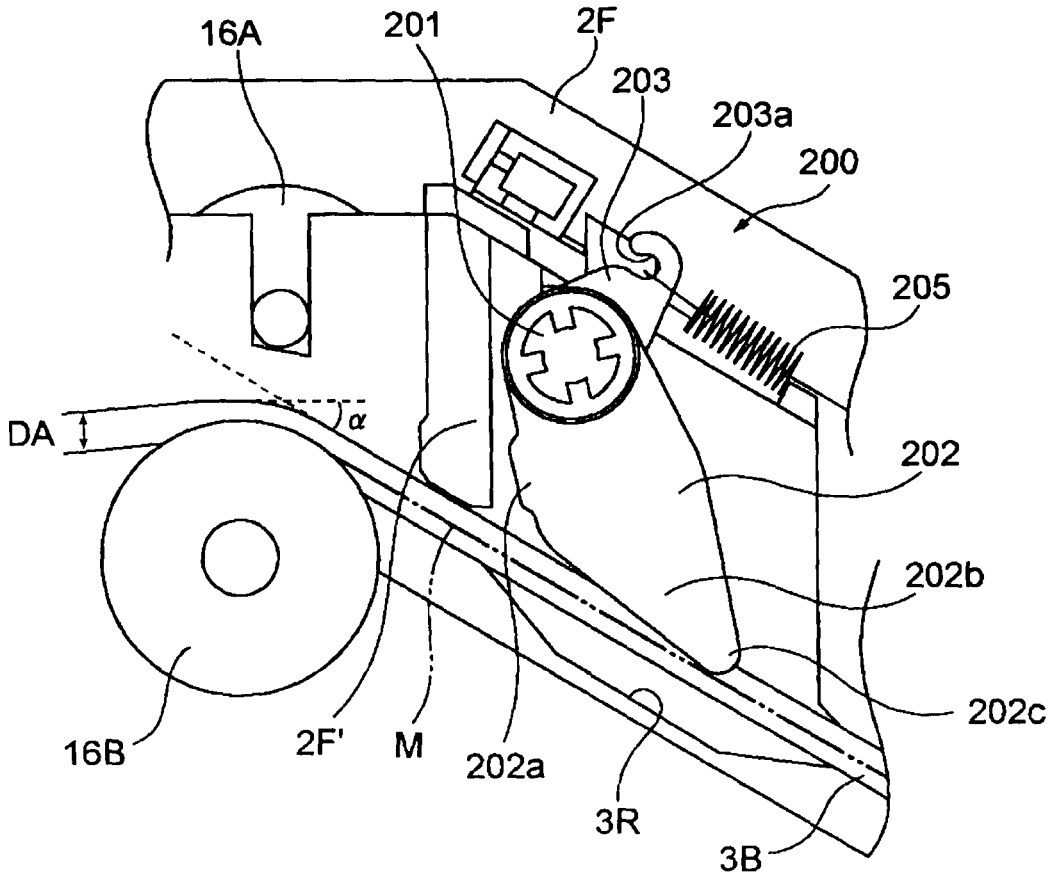
FIG. 8B is a view showing a state that a bill is conveyed toward a bill housing part and passing through the shutter member.

As shown in FIG. 8A, when a bill M is conveyed from the bill insertion slot side by the bill conveyance mechanism described above, the movable piece 202 constituting the shutter member 200 is rotated in the counterclockwise direction (in an arrow direction of FIG. 8A, on the downstream side and in the downstream direction, second rotational direction) against the biasing force of the biasing spring 205 due to the elasticity of the bill M (for example, bending stiffness). That is, a contact face (inclined face) of the movable piece 202 contacting the leading edge of the bill can provide a component force in a rotational moment toward the downstream side (the second rotational direction). Thus, the bill M passes through the movable piece 202 being rotated as shown in FIG. 8B, and then the bill is conveyed toward the bill housing part side. At this time, it is preferable that the force of the biasing spring 205 is in such a range that the bill M may not be damaged. Then, when the bill M passes through the shutter member 200, the movable piece 202 is rotated in the clockwise direction (in upstream direction, the first rotational direction) by the biasing force of the biasing spring 205, and its rotation is regulated as the regulating part 202*a* contacts the halt wall 2F', and as shown in FIG. 8A, the movable piece 202 blocks the second traveling route 3B again. Thus, once the second traveling route 3B is closed, even if the bill M is conveyed backward, the second traveling route 3B cannot be opened again. This is because a surface (downstream side surface) facing the downstream side opposite to a surface of the root part facing the upstream side and an inclined surface of the leading end part of the movable piece 202 is inclined toward upstream side as it extends from the bottom side of the recess 3R to the upper part in a traveling direction (e.g., a position where the spindle 201 is disposed). That is, the leading edge of the reversely-conveyed bill M contacts the downstream side surface and the contact force may cause a component force as a rotational moment on the downstream side surface in the counterclockwise direction (toward upstream side, the first rotational direction) of the movable piece 202.

Because the shutter member 200 configured as described above is installed in the second traveling route 3B inclined at the predetermined angle to the first traveling route 3A provided so as to be connected to the bill insertion slot 5, it is difficult to visually recognize the shutter member 200 from the bill insertion slot 5 such that an action of drawing out the bill can be prevented. Further, because the second traveling route 3B is inclined to the first traveling route 3A, even if a hard bar member is inserted thereto, it is difficult to reach the shutter member 200 such that the action of drawing out the bill can be prevented. Here, to be difficult to recognize the shutter member 200 visually is that the shutter member 200 is not substantially located within the range where it is visually recognizable since the shutter member 200 is disposed inside (that is, on the downstream side) the second traveling route 3B while only an entrance of the second traveling route 3B inclined at the predetermined angle can be seen through the first traveling route 3A extending linearly if it is seen from the bill insertion slot 5. And the predetermined angle corresponds to $\alpha$ in FIGS. 8A and 8B. In particular, suppose the height (in thickness direction of the bill) of the first traveling route 3A is DA, the height (in thickness direction of the bill) of the second traveling route 3B is DB, and the respective first and second traveling routes 3A and 3B are bent linearly, then $DB=DA*\cos(\alpha)$ such that it is preferable that shutter member 200 is disposed downstream by $DA/\tan(\alpha)$ or more along an extending direction of the first traveling route 3A. Here, the first and second traveling routes 3A and 3B may be bent in a curved manner as heights thereof are kept substantially the same. In this case, it is preferable that the shutter member 200 is disposed outside the range where it can be recognized along a traveling route face on a bent portion side in an extending direction of the first traveling route 3A from the bill insertion slot 5. Here, the traveling route face is a face defining the traveling route and regulating conveyance (or movement) of the bill in a thickness direction. And the bent portion side may mean a bent direction side when the first and second traveling routes 3A and 3B are connected with a bent portion.

Further, since the movable piece 202 constituting the shutter member 200 is supported rotatably by the frame 2F via the biasing spring 205, and its rotation toward the bill insertion slot is regulated by the regulating part 202*a* contacting the halt wall 2F', after the bill passes through the movable piece 202, even if an attempt is made to draw out the bill, the rotation of the movable piece 202 toward the bill insertion slot is regulated such that it can be reliably prevented that the bill is drawn out.

In particular, since the recess 3R is formed in the under surface portion of the second traveling route 3B, and the leading end portion 202*c* of the movable piece 202 is positioned in the recess 3R, the rotation toward the bill insertion slot is more reliably regulated such that it can be more reliably prevented that the bill is drawn out. That is, when the rotation of the movable piece 202 is regulated, the leading end portion 202*c* of the movable piece 202 is positioned in the recess 3R as the leading end portion 202*c* scoops the bottom face of the second traveling route 3B such that the second traveling route 3B is closed by the movable piece 202 such that it can be prevented that the bill is drawn out. The width of the recess 3R is a little wider than that of the movable piece 202 such that the movable piece 202 is formed to be rotatable. When the bill passes through the shutter member 200, the bill is nipped by the movable piece 202 and the recess 3R and is bent along a folding line or bent line in the traveling direction such that the bill becomes stiffer against the bend force in the traveling direction such that it is easier to apply the contact force against the movable piece 202.

Moreover, when the bill is positioned in the first traveling route (flat rear surface) 3A and the second traveling route (inclined surface) 3B during conveyance of the bill, it is possible to press down the bill by the shutter member 200 such that the bill can be conveyed smoothly.

As mentioned above, the embodiment of the present invention is described. However, the present invention is not limited to the above-described embodiment, and various modifications to the present invention can be implemented. It suffices for the shutter member 200 to be configured to be installed in the second traveling route 3B inclined at the predetermined angle to the first traveling route in the bill traveling route 3 to prevent the bill from being drawn out toward the bill insertion slot, and its concrete structure may be appropriately modified. For example, the shutter member may be configured not only to rotate to block the traveling route, but also to be popped up and depressed down from the surface of the second traveling route 3B to block the traveling route. Further, the various types of driving members installed in the bill processing apparatus, the driving source that drives these members, and the mechanism for transmitting power from the driving source may be appropriately modified.

According to the embodiment as described above, since the shutter member constituting a member to prevent the paper sheet from being drawn out is installed in the second traveling route inclined at the predetermined angle to the first traveling route provided so as to be connected to the insertion slot, it is difficult to visually recognize the shutter member from the insertion slot such that the action of drawing out the paper sheet can be prevented.

Further, the shutter member is supported rotatably by the frame constituting the second traveling route via the biasing means and its rotation toward the insertion slot can be regulated.

In such a configuration, when the paper sheet passes through the shutter member, even if an attempt is made to draw out the paper sheet, the rotation of the shutter member toward the insertion slot is regulated such that it can be reliably prevented that the paper sheet is drawn out.

Further, the recess may be formed in the position of the frame which the leading end portion of the shutter member touches.

According to such a configuration, since the shutter member supported rotatably touches the frame with the leading end portion of the shutter member in the recess of the frame, its rotation toward the insertion slot is more reliably regulated such that it can be more reliably prevented that the paper sheet is drawn out.

As described above, the bill processing apparatus which prevents the action of extracting the bill can be provided.

The paper sheet processing apparatus of the present invention can be incorporated into various types of apparatuses providing products and services by inserting a paper sheet such as a bill and a coupon ticket.

What is claimed is:

1. A paper sheet processing apparatus, comprising:

an insertion slot into which a paper sheet is inserted;

a traveling route through which the paper sheet having been inserted from the insertion slot is conveyed in a forward traveling direction, the traveling route including a first traveling route connected to the insertion slot and a second traveling route extending with a predetermined angle to the first traveling route;

a halt wall extending downward from a frame to configure the second traveling route; and a shutter member provided directly behind the halt wall with respect to the forward traveling direction and in the second traveling route that prevents the paper sheet from being withdrawn toward the insertion slot, the shutter member including a movable piece shaped in a wedge shape and including a root part, a locking part, a leading end portion, and a regulating portion, the locking part projecting from the root part on one end side in a longitudinal direction of the root part, the leading end portion being on another end side in the longitudinal direction, and the regulating part being formed on an upstream side of the leading end portion in the forward traveling direction, a spindle rotatably provided in the root part of the movable piece, and a biasing unit having a linear shape with a first end fixed to the locking part and a second end fixed to the frame to provide a linear contraction force between the first end and the second end, the contraction force biasing the movable piece to rotate around the spindle in a backward traveling direction to keep the second traveling route closed by causing the regulating part to contact the halt wall to support the contraction force and keep the leading end portion positioned across the second traveling route while the paper sheet is not in contact with the movable piece, wherein the movable piece of the shutter member is configured to rotate around the spindle and move the leading end portion across the second traveling route to open the second traveling route as the paper sheet travels in the forward traveling direction and the paper sheet pushes the movable piece, and to rotate back around the spindle in response to the contraction force to close the second traveling route by moving the leading end portion back across the second traveling route after the paper sheet passes the shutter member.

2. The paper sheet processing apparatus according to claim 1, wherein an end of the locking part is hook shaped, and the first end of the biasing unit is fixed to the hook shaped end of the locking part.

3. A paper sheet processing apparatus, comprising:

an insertion slot having an opening through which a paper sheet is inserted;

a first traveling route through which the paper sheet having been inserted from the insertion slot is conveyed in a forward traveling direction;

a second traveling route extending with a predetermined angle to the first traveling route;

a traveling route face in the second traveling route and included as a bottom floor of the second traveling route that regulates conveyance of the paper sheet in a thickness direction;

a shutter member disposed behind a halt wall and in the second traveling route that prevents withdrawal of the paper sheet in a backward traveling direction, wherein the shutter member includes a movable piece having a leading end portion and a root part, and a spindle provided in the root part, and the movable piece is configured to rotate around the spindle as the paper sheet travels in the forward traveling direction and the paper sheet pushes the movable piece, and to rotate back around the spindle to close the second traveling route after the paper sheet passes the shutter member;

a recess provided on the traveling route face in which at least part of the leading end portion is inserted below the traveling route face; and a linearly-shaped elastic body that biases the leading end portion in the backward traveling direction, wherein one end of the elastic body is fixed to a locking part projecting from the root part of the movable piece and another end of the elastic body is fixed to a frame included in the second traveling route, the elastic body applies the bias linearly between the locking part and the frame, and the movable piece is rotated against a biasing force of the elastic body in the backward traveling direction such that the second traveling route is opened when the paper sheet passes the shutter member, wherein the halt wall is provided directly in front of the shutter member with respect to the forward travelling direction, extends downward from the frame, and regulates rotation of the movable piece biased in the forward traveling direction, the movable piece includes a projection formed on an upstream side of the movable piece, and the projection touches the halt wall to regulate the rotation of the movable piece.

4. The paper sheet processing apparatus according to claim 3, further comprising a second shutter member arranged next to the shutter member in a direction lateral to the forward traveling direction in the second traveling route, wherein the shutter member and the second shutter member including a second movable piece are formed narrower than a width of the second traveling route.

5. The paper sheet processing apparatus according to claim 4, further comprising a second recess in which at least part of a leading end portion of the second shutter is inserted below the traveling route face, wherein the recess and the second recess, corresponding to the shutter member and the second shutter member respectively, are formed a little wider than respective widths of the movable piece and the second movable piece.

* * * * *